US010748480B2

(12) United States Patent
Zeng et al.

(10) Patent No.: US 10,748,480 B2
(45) Date of Patent: Aug. 18, 2020

(54) METHOD OF COMPENSATING AMOLED PIXEL DIFFERENCE

(71) Applicant: SHENZHEN CHINA STAR OPTOELECTRONICS SEMICONDUCTOR DISPLAY TECHNOLOGY CO., LTD., Shenzhen, Guangdong (CN)

(72) Inventors: Yuchao Zeng, Guangdong (CN); Pengfei Liang, Guangdong (CN)

(73) Assignee: SHENZHEN CHINA STAR OPTOELECTRONICS SEMICONDUCTOR DISPLAY TECHNOLOGY CO., LTD., Shenzhen (CN)

( * ) Notice: Subject to any disclaimer, the term of this patent is extended or adjusted under 35 U.S.C. 154(b) by 347 days.

(21) Appl. No.: 15/735,508

(22) PCT Filed: Nov. 23, 2017

(86) PCT No.: PCT/CN2017/112484
§ 371 (c)(1),
(2) Date: Dec. 11, 2017

(87) PCT Pub. No.: WO2019/061767
PCT Pub. Date: Apr. 4, 2019

(65) Prior Publication Data

US 2020/0035154 A1 Jan. 30, 2020

(30) Foreign Application Priority Data

Sep. 28, 2017 (CN) ..... 2017 1 0897163

(51) Int. Cl.
*G09G 3/3233* (2016.01)

(52) U.S. Cl.
CPC ..... *G09G 3/3233* (2013.01); *G09G 2320/029* (2013.01); *G09G 2320/0233* (2013.01); *G09G 2330/12* (2013.01)

(58) Field of Classification Search
CPC ..... G09G 3/3233; G09G 2320/029; G09G 2320/045; G09G 2300/043
See application file for complete search history.

(56) References Cited

U.S. PATENT DOCUMENTS 6,882,958 B2 4/2005 Schmidt et al.
9,355,595 B2 5/2016 Qi et al.
(Continued)

FOREIGN PATENT DOCUMENTS

CN 103594059 A 2/2014
CN 104050664 9/2014
(Continued)

*Primary Examiner* — Gerald Johnson
(74) *Attorney, Agent, or Firm* — Hemisphere Law, PLLC; Zhigang Ma

(57) ABSTRACT

The present disclosure provides a method of compensating AMOLED pixel difference, including the steps of: fitting the driving voltage value and the driving current value of the reference pixel. Acquiring the threshold voltage, the coefficient and the power value corresponding to the reference pixel according to the fitting result. Acquiring the threshold change of the threshold voltage corresponding to the other pixel relative to the threshold voltage corresponding to the reference pixel and the coefficient ratio of the coefficient corresponding to the other pixel relative to the coefficient corresponding to the reference pixel. Compensating the other pixel difference according to the threshold change, the coefficient ratio and the power value. The disclosure makes the driving current under the same driving voltage be consistent, improves the uniformity of the light-emitting intensity of the AMOLED and enhances the display quality of the AMOLED display device.

14 Claims, 2 Drawing Sheets

(56) References Cited

U.S. PATENT DOCUMENTS

| | | | | |
|---|---|---|---|---|
| 9,805,654 | B2 | 10/2017 | Yang et al. | |
| 9,824,633 | B2 | 11/2017 | Qing et al. | |
| 2010/0171738 | A1 | 7/2010 | Yamashita et al. | |
| 2012/0044235 | A1* | 2/2012 | Cha | G09G 3/3233 345/212 |
| 2013/0050292 | A1* | 2/2013 | Mizukoshi | G09G 3/3291 345/690 |
| 2013/0162617 | A1* | 6/2013 | Yoon | G09G 3/3291 345/211 |
| 2014/0098082 | A1* | 4/2014 | Kwon | G09G 3/3291 345/212 |
| 2019/0066578 | A1* | 2/2019 | Chen | G09G 3/3291 |

FOREIGN PATENT DOCUMENTS

| | | |
|---|---|---|
| CN | 104252846 | 12/2014 |
| CN | 104269157 | 1/2015 |
| CN | 107146576 A | 9/2017 |
| KR | 1020160044133 | 4/2016 |

* cited by examiner

METHOD OF COMPENSATING AMOLED PIXEL DIFFERENCE

RELATED APPLICATIONS

The present application is a National Phase of International Application Number PCT/CN2017/112484, filed Nov. 23, 2017, and claims the priority of China Application No. 261716897163.8, filed Sep. 28, 2017.

FIELD OF THE DISCLOSURE

The present disclosure relates to a display technology field, and more particularly to a method of compensating AMOLED pixel difference.

BACKGROUND OF THE DISCLOSURE

Organic light emitting diode (OLED) display panel due to the advantages of thin, light, wide viewing angle, active light, light color continuously adjustable, low cost, fast response, low energy consumption, low drive voltage, wide operating temperature range, simple production process, high luminous efficiency and flexible display, etc., has been listed as a promising future generation of display technology. OLED display devices are usually use ITO pixel electrode and metal electrodes, as the device anode and cathode, respectively. By driven under a certain voltage, electron and hole transport layer migrate to the light-emitting layer, and meet in the light-emitting layer to issue visible light.

The OLED display device is divided into passive matrix type (PMOLED) and active matrix type (AMOLED) according to the driving method. AMOLED is a current driving device, when a current flow through the organic light-emitting diode, the brightness of the organic light-emitting diode is determined by the current flowing through its own, and the formula is: $Ids=K(Vgs-Vth)^x$. Wherein Vth is the threshold voltage, k is the coefficient, and x is the power value in the drive current calculation formula. Most of the integrated circuits only transmit voltage signals, so AMOLED pixel drive circuit needs to complete the task turning voltage signal into the current signal, the traditional AMOLED pixel drive circuit for the 2T1C structure, that is, two thin film transistors plus a storage capacitor.

However, the threshold voltage and the coefficient of the driving thin film transistor between each pixel of the AMOLED are different, so that the driving current at the same driving voltage does not coincide, resulting in uneven luminance of AMOLED, which affects the display quality of AMOLED display device.

SUMMARY OF THE DISCLOSURE

The technical problem that the present disclosure mainly solves is to provide a method of compensating AMOLED pixel difference, which can realize the compensation of pixel difference in pixel circuit.

In order to solve the above-mentioned technical problems, the first technical solution adopted by the present disclosure is: electrically connecting a detection device with an output terminal of a pixel driving circuit, acquiring a potential value of an output terminal of each pixel driving circuit; fitting a driving voltage value and a driving current value of one reference pixel, acquiring a threshold voltage and a coefficient of a driving thin film transistor and a power value in a driving current calculation formula corresponding to the one reference pixel according to the fitting result; acquiring a threshold change of the threshold voltage of the driving thin film transistor corresponding to the other pixel relative to the threshold voltage of the driving thin film transistor corresponding to the one reference pixel and acquiring a coefficient ratio of the coefficient of the driving thin film transistor corresponding to the other pixel relative to the coefficient of the driving thin film transistor corresponding to the one reference pixel; and compensating the other pixel difference according to the threshold change, the coefficient ratio and the power value in the driving current calculation formula.

In order to solve the above technical problems, the second technical solution adopted by the present disclosure is: electrically connecting a detection device with an output terminal of a pixel driving circuit, acquiring a potential value of an output terminal of each pixel driving circuit; fitting a driving voltage value and a driving current value of a plurality of reference pixels, acquiring a threshold voltage and a coefficient of a driving thin film transistor and a power value in a driving current calculation formula corresponding to the plurality of reference pixels according to the fitting result, wherein the threshold voltage, the coefficient and the power value in the driving current calculation formula are the average value of the threshold voltages, the average value of the coefficients and the average value of the power values in the driving current calculation formula of the plurality of reference pixels; acquiring a threshold change of the threshold voltage of the driving thin film transistor corresponding to the other pixel relative to the threshold voltage of the driving thin film transistor corresponding to the plurality of reference pixels and acquiring a coefficient ratio of the coefficient of the driving thin film transistor corresponding to the other pixel relative to the coefficient of the driving thin film transistor corresponding to the plurality of reference pixels; and compensating the other pixel difference according to the threshold change, the coefficient ratio and the power value in the driving current calculation formula.

In order to solve the above technical problems, the third technical solution adopted by the present disclosure is: fitting a driving voltage value and a driving current voltage of a reference pixel, acquiring a threshold voltage and a coefficient of a driving thin film transistor and a power value in a driving current calculation formula corresponding to the reference pixel according to the fitting result; acquiring a threshold change of the threshold voltage of the driving thin film transistor corresponding to the other pixel relative to the threshold voltage of the driving thin film transistor corresponding to the reference pixel and acquiring a coefficient ratio of the coefficient of the driving thin film transistor corresponding to the other pixel relative to the coefficient of the driving thin film transistor corresponding to the reference pixel; and compensating the other pixel difference according to the threshold change, the coefficient ratio and the power value in the driving current calculation formula.

The disclosure has the advantages that: different from the prior art, the disclosure acquires the threshold voltage, the coefficient and the power value in the driving current calculation formula of the driving thin film transistor corresponding to the reference pixel by curve fitting the driving voltage value and the driving current value of the reference pixel, and compensates the difference of each pixel according to the threshold change, the coefficient value and the power value in the driving current calculation formula, thereby improves the display quality of the AMOLED display device.

DETAILED DESCRIPTION OF PREFERRED EMBODIMENTS

The technical solution in the embodiments of the present disclosure will be described in the following with reference to the accompanying drawings in the embodiments of the present disclosure. Obviously, the described embodiments are merely part of the present disclosure, and not all embodiments. All other embodiments obtained by those of ordinary skill in the art without making creative work are within the scope of the present disclosure, based on embodiments in the present disclosure.

Figure 1:
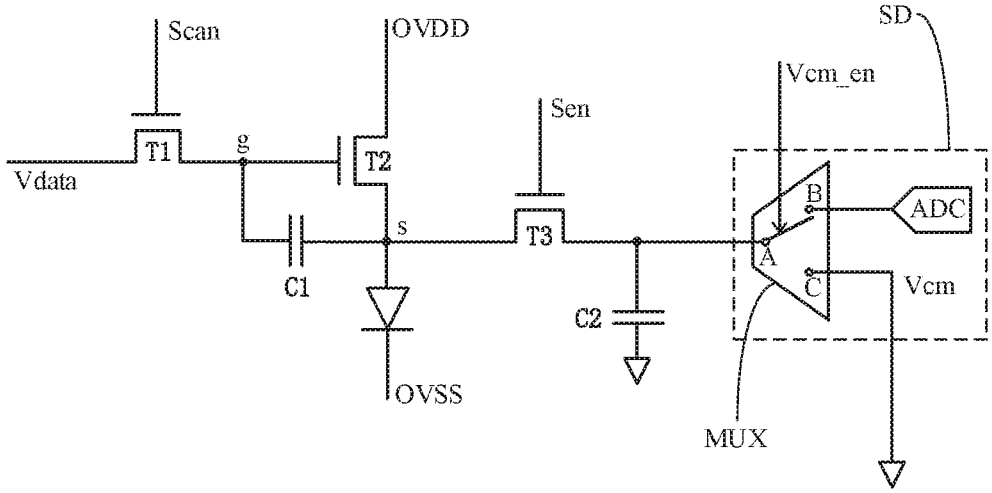
FIG. 1 is a schematic structural diagram of an AMOLED pixel driving circuit and its detection device according to the present disclosure.

FIG. 1 is a schematic structural diagram of an AMOLED pixel driving circuit and its detection device according to the present disclosure. Wherein the pixel driving circuit includes: a first thin film transistor T1, a driving thin film transistor T2, a third thin film transistor T3, a first capacitor C1, a second capacitor C2 and an organic light emitting diode OLED. The gate of the first thin film transistor T1 is connected to the scanning signal Scan. The source and drain of the first thin film transistor T1 are respectively connected to the gate of the data signal Vdata and the driving thin film transistor T2. The first thin film transistor T1 transmits the data voltage Vdata to the gate of the driving thin film transistor T2 under the control of the scanning signal Scan. The source and drain of the driving thin film transistor T2 are respectively connected to the anode and power supply positive OVDD of the organic light emitting diode OLED. The bipolar plate of the first capacitor C1 is respectively connected to the gate and source of the driving thin film transistor T2. The cathode of the organic light emitting diode OLED is connected with the power supply negative OVSS. The source and gate of the third thin film transistor T3 are respectively connected to the source and detection signal Sen of the driving thin film transistor T2. The third thin film transistor T3 electrically connects the detection device SD with the output terminal of the pixel driving circuit to acquire the potential value of the output terminal of each pixel driving circuit under the control of the detection signal Sen. The plate of the second capacitor C2 and the drain of the third thin film transistor T3 are connected with the detection device SD. The other terminal of the second capacitor C2 is grounded. The detection device includes a multiplexer and an analog-to-digital converter. The multiplexer is controlled by a switching signal, and is electrical connection switched between the common voltage terminal and the input terminal of the analog-to-digital converter. In the present embodiment, the output terminal of the pixel driving circuit is electrically connected with the analog-to-digital converter ADC when the switching signal Vcm_en controls the A and B terminals of the multiplexer MUX to be turned on; the output terminal of the pixel driving circuit is electrically connected with the common voltage terminal Vcm when the switching signal Vcm_en controls the A and C terminals of the multiplexer MUX to be turned on. Wherein the potential of the common voltage terminal Vcm is lower than the threshold voltage of the organic light emitting diode OLED, and in the present embodiment, the common voltage terminal Vcm is grounded.

Figure 2:
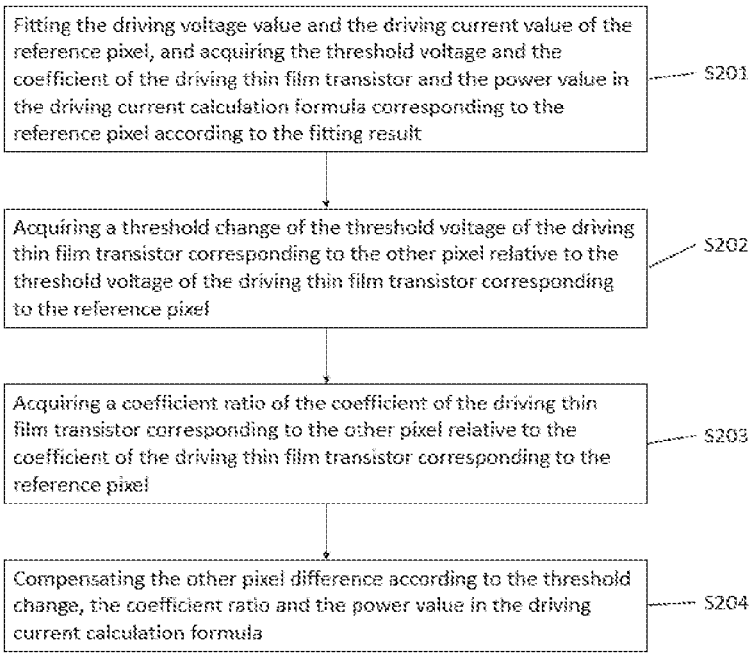
FIG. 2 is a schematic flow diagram of an embodiment of the method of compensating AMOLED pixel difference of the present disclosure.
Figure 3:
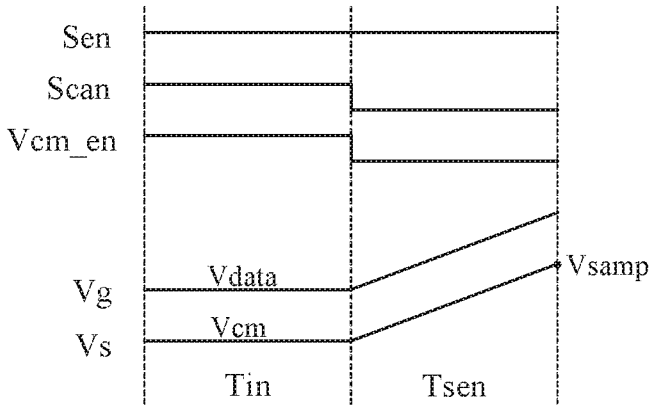
FIG. 3 is a circuit timing diagram of the Vgs-Ids curve fitting stage in the embodiment of the method of compensating AMOLED pixel difference of the present disclosure.
Figure 4:
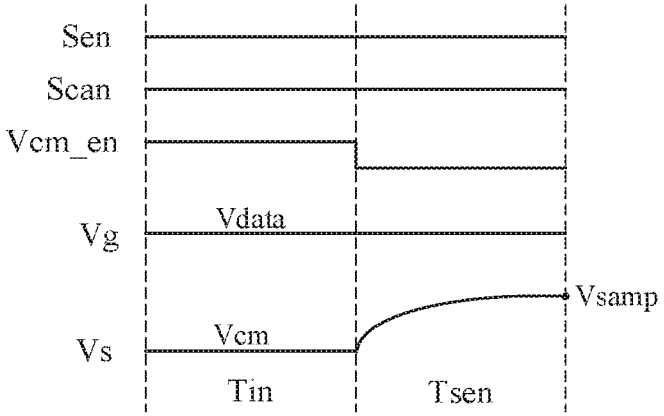
FIG. 4 is a circuit timing diagram of the ΔVth detection phase during the embodiment of the method of compensating AMOLED pixel difference of the present disclosure.
Figure 5:
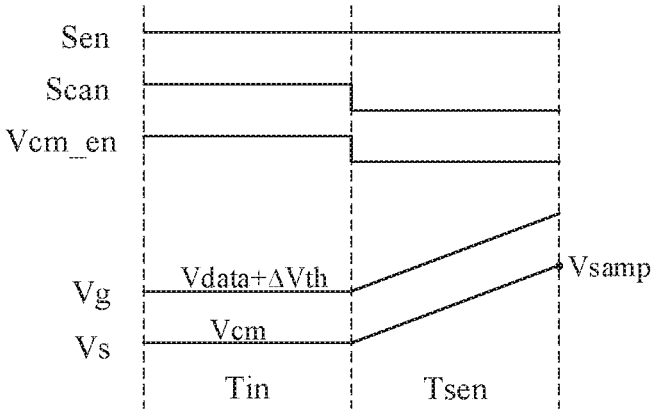
FIG. 5 is a circuit timing diagram of the Kref/K detection phase during the embodiment of the method of compensating AMOLED pixel difference of the present disclosure.

FIG. 2 is a schematic flow diagram of an embodiment of the method of compensating AMOLED pixel difference of the present disclosure. The step 201 is mainly to achieve the curve fitting of the driving voltage value (VGS) and the driving current value (IDS). FIG. 4 is a circuit timing diagram of the? Vth detection phase during the embodiment of the method of compensating AMOLED pixel difference of the present disclosure. The step 203 is mainly to achieve the detection of the coefficient ratio (Kref/K). FIG. 5 is a circuit timing diagram of the Kref/K detection phase during the embodiment of the method of compensating AMOLED pixel difference of the present disclosure. Wherein Vg and Vs are the gate potential and the source potential of the driving thin film transistor T2, respectively.

In the following, the operation of the AMOLED pixel difference method according to the present disclosure will be described in detail with reference to FIGS. 2 to 5.

Step 201: fitting the driving voltage value and the driving current value of the reference pixel, and acquiring the threshold voltage and the coefficient of the driving thin film transistor and the power value in the driving current calculation formula corresponding to the reference pixel according to the fitting result.

In the present embodiment, the first thin film transistor T1 and the third thin film transistor T3 in the reference pixel are turned on by controlling the scanning signal Scan, the detection signal Sen and the switching signal Vcm_en. And the output terminal of the reference pixel driving circuit is electrically connected to the common voltage terminal Vcm so as to input a fixed potential to the gate and the source of the reference pixel driving thin film transistor T2. Wherein the first thin film transistor T1 transmits the data voltage Vdata to the gate of the driving thin film transistor T2 under the control of the scanning signal Scan. The third thin film transistor T3 and the multiplexer MUX transmit the potential of the common voltage terminal Vcm to the source of the driving thin film transistor T2 under the control of the detection signal Sen and the switching signal Vcm_en. After the time Tin, disconnecting the input potential of the gate and source, at the same time, the A terminal of the multiplexer MUX is connected with the B terminal at the control of the switching signal Vcm_en so that the output terminal of the pixel driving circuit is electrically connected with the analog-to-digital converter ADC. After the time Tsen, the analog-to-digital converter ADC acquires the source potential value Vsamp of the reference pixel driving thin film transistor T2. In the present embodiment, the threshold voltage and the source potential of the reference pixel are denoted as Vthref and Vsampref, respectively.

Since the driving voltage value between the gate and the source of the driving thin film transistor T2 is a fixed value at this stage, which is: vgs=Vdata−Vcm, where Vdata and Vcm are the data voltage and the potential value of the common potential, so the driving current value is also a fixed value, the driving current value is calculated as: Ids=(C1+C2)*(Vsamp−Vcm)/Tsem, where C1 and C2 are the capacitance values of the first capacitor and the second capacitor, respectively, and Vsamp is the source potential value of the ADC converter via Tsen time. Thereby acquiring a set of the driving voltage value and the driving current value. Then, by changing the input potential value of the gate of the driving thin film transistor T2, the above steps are repeated to acquire a plurality sets of the driving voltage value and the driving current value, the Vgs−Ids curve fitting is performed based on the acquired plurality sets of the driving voltage value and the driving current value, and the threshold voltage, the coefficient and the power value x in the driving current calculation formula of the reference pixel driving thin film transistor T2 are acquired. In the present embodiment, the selected reference pixel is one pixel, the fitted threshold voltage, the fitted coefficient and the fitted power value in the driving current calculation formula are the threshold voltage, the coefficient and the power value in the driving current calculation formula of the one pixel. In other embodiment, the selected reference pixels can be a plurality of pixels, are Vgs−Ids curve fitted to the plurality of pixels to acquire the threshold voltage, the coefficient and the power values in the driving current calculation formula, and the values are averaged respectively. The average value of the threshold voltage, the average value of the coefficient and the average value of the power value in the driving current calculation formula of the plurality of reference pixels are the threshold voltage, the coefficient and the power value in the driving current calculation formula of the reference pixel.

Step 202: acquiring a threshold change of the threshold voltage of the driving thin film transistor corresponding to the other pixel relative to the threshold voltage of the driving thin film transistor corresponding to the reference pixel.

In the present embodiment, inputting the same potential value to the gate and the source of each pixel driving thin film transistor T2 respectively. The first thin film transistor T1 transmits the data voltage Vdata to the gate of the driving thin film transistor T2 under the control of the scanning signal Scan. The third thin film transistor T3 and the multiplexer MUX transmit the potential of the common voltage terminal Vcm to the source of the driving thin film transistor T2 under the control of the detection signal Sen and the switching signal Vcm_en. After the elapse of time Tin, the input potential of the source of the driving thin film transistor T2 is disconnected. At the same time, the A terminal of the multiplexer MUX is connected with the B terminal at the control of the switching signal Vcm_en so that the output terminal of the pixel driving circuit is electrically connected with the analog-to-digital converter ADC. When the time is Tsen, the analog-to-digital converter ADC acquires the source potential value Vsamp of each pixel driving thin film transistor T2.

In the time period Tsen, since (Vdata−Vcm) is greater than Vth, the driving current charges Vs until Vs reaches (Vdata−Vth). That is, when the time Tsen is used, the source potential value Vsamp of each pixel driving thin film transistor T2 of the analog-to-digital converter ADC acquired is (Vdata−Vth). Since the threshold voltage Vth of the driving thin film transistor T2 in each pixel is different, the obtained (Vdata−Vth) is also different. The difference of the source potential value is acquired after the source potential of the reference pixel subtracted from the source potential of the other pixel, i.e. the threshold change. The threshold change is: ΔVth=(Vsampref−Vsamp). Wherein Vsampref is the source potential value of the reference pixel over time Tsen and Vsamp is the source potential value of any other pixel.

Step 203: acquiring a coefficient ratio of the coefficient of the driving thin film transistor corresponding to the other pixel relative to the coefficient of the driving thin film transistor corresponding to the reference pixel.

At this stage, the gate and the source of each pixel driving thin film transistor T2 are inputted potential respectively. Wherein the potential value inputted from each pixel gate is the sum of the data voltage value and the threshold change, the potential value of each pixel source is the same. The first thin film transistor T1 transmits the potential (Vdata−ΔVth) to the gate of the driving thin film transistor T2 under the control of the scanning signal Scan. The third thin film transistor T3 and the multiplexer MUX transmit the potential of the common voltage terminal Vcm to the source of the driving thin film transistor T2 under the control of the detection signal Sen and the switching signal Vcm_en. After the time Tin, the input potential of the gate and the source of the driving thin film transistor T2 is disconnected. At the same time, the A terminal of the multiplexer MUX is connected with the B terminal at the control of the switching signal Vcm_en so that the output terminal of the pixel driving circuit is electrically connected with the analog-to-digital converter ADC. After the time Tsen, the analog-to-digital converter ADC acquires the source potential value Vsamp of each pixel driving thin film transistor T2.

Since the driving voltage value between the gate and the source of the driving thin film transistor T2 is a fixed value (Vdata+ΔVth−Vcm) at this stage, the driving current Ids is a fixed value. The driving current is calculated as: Ids=(C1+C2)*(Vsamp−Vcm)/Tsen. Each pixel driving circuit is $Ids=K(Vgs-Vth)^x=K(Vdata+\Delta Vth-Vcm-(Vthref+\Delta Vth))^x=K(Vdata-Vcm-Vthref)^x$. In the formula $Ids=K(Vdata-Vcm-Vthref)^x$, there is only one variable of K value, K is the coefficient of the other pixel driving thin film transistor T2, and the relationship is obtained: Kref/K=Idsref/Ids, and Idsref/Ids=(Vsampref−Vcm)/(Vsamp−Vcm). Which the coefficient ratio can be calculated by the relationship formula Kref/K=(Vsampref−Vcm)/(Vsamp−Vcm). Wherein Kref/K represents the coefficient ratio, Vcm represents the input source potential value, Vsampref and Vsamp respectively represent the source potential values of the reference pixel and the other pixel acquired after disconnecting the input potential and after the same time. Idsref and Ids are the driving currents of the reference pixels and the other pixels, respectively.

Step 204: compensating the other pixel difference according to the threshold change, the coefficient ratio and the power value in the driving current calculation formula.

If the driving voltage value between the gate and the source of the pixel driving thin film transistor T2 is Vgs, the difference between the coefficient of driving thin film transistor T2 corresponding to the other pixel is compensated, and the compensation result is:

$$Vgs' = \sqrt[x]{Kref/K} * Vgs;$$

the difference between the threshold voltages of the driving thin film transistor T2 corresponding to the other pixels is compensated, and the compensation result is: Vgs"=Vgs'+Vthref+ΔVth. Wherein ΔVth is the threshold change, Vthref is the threshold voltage of the reference pixel, Vgs' is the driving voltage value after the coefficient difference compensation. For all other pixels, Vgs" is displayed, Vgs" is the driving voltage value after the coefficient and threshold voltage difference compensation, then the compensation driving current is: $Ids''=K(Vgs''-(Vthref-\Delta Vth))^x=KrefVgs^x$.

It can be seen from the compensated driving current formula that the driving current has no relation with the threshold voltage and the coefficient difference of the driving thin film transistor T2 between the pixels, that is, the driving current is ensured to be consistent.

It can be seen from the above that in the present disclosure, the threshold voltage and the coefficient of the driving thin film transistor and the power value in the driving current calculation formula corresponding to the reference pixel are acquired by curve fitting the driving voltage value and the driving current value of the reference pixel, and compensates for the differences of other pixels according to the threshold change, the coefficient ratio and the power value in the driving current calculation formula, so that the driving current is consistent, the uniformity of the light emitting brightness of the AMOLED is improved, and the display quality of the AMOLED display device is improved.

Obviously, those skilled in the art can make various modifications and variations to the present disclosure without departing from the spirit and scope of the present disclosure. In this way, if these modifications and variations of the present disclosure fall within the scope of the claims of the present disclosure and its equivalent technologies, the present disclosure is also intended to include these changes and modifications.

What is claimed is:

1. A method of compensating AMOLED pixel difference, comprising the steps of:

electrically connecting a detection device with an output terminal of a pixel driving circuit, acquiring a potential value of an output terminal of each pixel driving circuit;

fitting a driving voltage value and a driving current value of one reference pixel, acquiring a threshold voltage and a coefficient of a driving thin film transistor and a power value in a driving current calculation formula corresponding to the one reference pixel according to the fitting result;

acquiring a threshold change of the threshold voltage of the driving thin film transistor corresponding to the other pixel relative to the threshold voltage of the driving thin film transistor corresponding to the one reference pixel, and acquiring a coefficient ratio of the coefficient of the driving thin film transistor corresponding to the other pixel relative to the coefficient of the driving thin film transistor corresponding to the one reference pixel; and compensating the other pixel difference according to the threshold change, the coefficient ratio and the power value in the driving current calculation formula;

wherein the detection device comprises a multiplexer and an analog-to-digital converter; the multiplexer comprises a first terminal electrically connecting the output terminal, a second terminal electrically connecting the analog-to-digital converter, and a third terminal electrically connecting a common voltage terminal; and the multiplexer is controlled by a switching signal to switchably control the first terminal and the second terminal to be turned on or the first terminal and the third terminal to be turned on;

wherein the step of fitting a driving voltage value and a driving current value of one reference pixel, acquiring a threshold voltage and a coefficient of a driving thin film transistor and a power value in a driving current calculation formula corresponding to the one reference pixel according to the fitting result comprises the following specific steps:

inputting fixed potentials respectively to a gate of the driving thin film transistor of the one reference pixel through a first thin film transistor for transmitting a data voltage (Vdata) under the control of a scanning signal and a source of the driving thin film transistor of the one reference pixel through the detection device in a state of the first terminal and the third terminal being turned on, and thereby a potential of the common voltage terminal and the data voltage as the fixed potentials being transmitted to the source and the gate respectively;

disconnecting the input potentials of the gate and the source while controlling the multiplexer by the switching signal to be switched from the state of the first terminal and the third terminal being turned on to another state of the first terminal and the second terminal being turned on, acquiring a set of driving voltage value and driving current value;

changing the input potential value of the gate, repeating the above inputting and disconnecting steps, acquiring a plurality sets of driving voltage value and driving current value;

curve-fitting the plurality sets of the driving voltage value and the driving current value, and acquiring the threshold voltage and the coefficient of the driving thin film transistor and the power value in the driving current calculation formula corresponding to the one reference pixel according to the fitting result.

2. The method of compensating AMOLED pixel difference according to claim 1, wherein the step of acquiring a threshold change of the threshold voltage of the driving thin film transistor corresponding to the other pixel relative to the threshold voltage of the driving thin film transistor corresponding to the one reference pixel comprises the following specific steps:

inputting the same potential values respectively to a gate and a source of each pixel driving thin film transistor, respectively;

disconnecting the input potential of the source, and after the same time, acquiring a source potential value of each pixel; and acquiring a potential difference of the source potential value by subtracting the source potential value of the other pixel from the source potential value of the one reference pixel, that is the threshold change.

3. The method of compensating AMOLED pixel difference according to claim 2, wherein the step of acquiring a coefficient ratio of the coefficient of the driving thin film transistor corresponding to the other pixel relative to the coefficient of the driving thin film transistor corresponding to the one reference pixel comprises the following specific steps:

respectively inputting potentials to the gate and the source of each pixel driving thin film transistor, wherein the potential value inputted to each pixel gate is a sum of the data voltage value and the threshold change, and the potential value of each pixel source is the same;

disconnecting the input potentials of the gate and the source, and after the same time, acquiring a source potential value of each pixel, and calculating the coefficient ratio by the formula $Kref/K=(Vsampref-Vcm)/(Vsamp-Vcm)$, wherein Kref/K represents the coefficient ratio, Vcm represents the input source potential value, Vsampref and Vsamp respectively represent the source potential values of the one reference pixel and the other pixel acquired after disconnecting the input potential and after the same time.

4. The method of compensating AMOLED pixel difference according to claim 3, wherein the step of compensating the other pixel difference according to the threshold change, the coefficient ratio and the power value in the driving current calculation formula comprises the following specific steps:

compensating the difference of the driving thin film transistor coefficient corresponding to the other pixel, wherein the compensation formula is:

$$Vgs' = \sqrt[x]{Kref / K} * Vgs,$$

x is the power value in the driving current calculation formula, Vgs is the driving voltage value before the compensation;

compensating the difference of the driving thin film transistor threshold voltage corresponding to the other pixel, wherein the compensation formula is: Vgs"=Vgs'+Vthref+ΔVth, ΔVth is the threshold change, Vthref is the threshold voltage of the one reference pixel, and Vgs' is the driving voltage value after the coefficient difference compensation.

5. The method of compensating AMOLED pixel difference according to claim 1, wherein the common voltage terminal is grounded.

6. A method of compensating AMOLED pixel difference, comprising the steps of:

electrically connecting a detection device with an output terminal of a pixel driving circuit, acquiring a potential value of an output terminal of each pixel driving circuit;

fitting a driving voltage value and a driving current value of a plurality of reference pixels, acquiring a threshold voltage and a coefficient of a driving thin film transistor and a power value in a driving current calculation formula corresponding to the plurality of reference pixels according to the fitting result, wherein the threshold voltage, the coefficient and the power value in the driving current calculation formula are the average value of the threshold voltages, the average value of the coefficients and the average value of the power values in the driving current calculation formula of the plurality of reference pixels;

acquiring a threshold change of the threshold voltage of the driving thin film transistor corresponding to the other pixel relative to the threshold voltage of the driving thin film transistor corresponding to the plurality of reference pixels and acquiring a coefficient ratio of the coefficient of the driving thin film transistor corresponding to the other pixel relative to the coefficient of the driving thin film transistor corresponding to the plurality of reference pixels; and compensating the other pixel difference according to the threshold change, the coefficient ratio and the power value in the driving current calculation formula;

wherein the detection device comprises a multiplexer and an analog-to-digital converter; the multiplexer comprises a first terminal electrically connecting the output terminal, a second terminal electrically connecting the analog-to-digital converter, and a third terminal electrically connecting a common voltage terminal; the multiplexer is controlled by a switching signal to switchably control the first terminal and the second terminal to be turned on or the first terminal and the third terminal to be turned on; a potential of the common voltage terminal is transmitted to a source of the driving thin film transistor of the reference pixel in a situation of the first terminal and the third terminal being turned on under the control of the switching signal and meanwhile a data voltage (Vdata) is transmitted to a gate of the driving thin film transistor of the reference pixel through a first thin film transistor for transmitting the data voltage.

7. The method of compensating AMOLED pixel difference according to claim 6, wherein the common voltage terminal is grounded.

8. A method of compensating AMOLED pixel difference, comprising the steps of:

fitting a driving voltage value and a driving current voltage of a reference pixel, acquiring a threshold voltage and a coefficient of a driving thin film transistor and a power value in a driving current calculation formula corresponding to the reference pixel according to the fitting result;

acquiring a threshold change of the threshold voltage of the driving thin film transistor corresponding to the other pixel relative to the threshold voltage of the driving thin film transistor corresponding to the reference pixel and acquiring a coefficient ratio of the coefficient of the driving thin film transistor corresponding to the other pixel relative to the coefficient of the driving thin film transistor corresponding to the reference pixel; and compensating the other pixel difference according to the threshold change, the coefficient ratio and the power value in the driving current calculation formula;

wherein the step of fitting a driving voltage value and a driving current voltage of a reference pixel, acquiring a threshold voltage and a coefficient of a driving thin film transistor and a power value in a driving current calculation formula corresponding to the reference pixel according to the fitting result comprises the following specific steps:

inputting fixed potentials respectively to a gate of the reference pixel driving thin film transistor through a first thin film transistor for transmitting a data voltage (Vdata) under the control of a scanning signal and a source of the reference pixel driving thin film transistor through a detection device in a state of a first terminal and a third terminal being turned on, and thereby a potential of a common voltage terminal and the data voltage as the fixed potentials being transmitted to the source and the gate respectively, wherein the detection device comprises a multiplexer and an analog-to-digital converter, the multiplexer comprises the first terminal, a second terminal electrically connecting the analog-to-digital converter, and a third terminal electrically connecting the common voltage terminal, and the multiplexer is controlled by a switching signal to switchably control the first terminal and the second terminal to be turned on or the first terminal and the third terminal to be turned on;

disconnecting the input potentials of the gate and the source while controlling the multiplexer by the switching signal to be switched from the state of the first terminal and the third terminal being turned on to another state of the first terminal and the second terminal being turned on, acquiring a set of driving voltage value and driving current value;

changing the input potential value of the gate, repeating the above steps, acquiring a plurality sets of driving voltage value and driving current value;

curve-fitting the plurality sets of the driving voltage value and the driving current value, and acquiring the threshold voltage and the coefficient of the driving thin film transistor and the power value in the driving current calculation formula corresponding to the reference pixel according to the fitting result.

9. The method of compensating AMOLED pixel difference according to claim 8, wherein the threshold voltage, the coefficient and the power value in the driving current calculation formula are the threshold voltage, the coefficient and the power value in the driving current calculation formula of one reference pixel.

10. The method of compensating AMOLED pixel difference according to claim 8, wherein the threshold voltage, the coefficient and the power value in the driving current calculation formula are the average value of the threshold voltages, the average value of the coefficients and the average value of the power values in the driving current calculation formula of the plurality of reference pixels.

11. The method of compensating AMOLED pixel difference according to claim 8, wherein the step of acquiring a threshold change of the threshold voltage of the driving thin film transistor corresponding to the other pixel relative to the threshold voltage of the driving thin film transistor corresponding to the reference pixel comprises the following specific steps:

inputting the same potential values respectively to the gate and the source of each pixel driving thin film transistor, respectively;

disconnecting the input potential of the source, and after the same time, acquiring the source potential of each pixel; and acquiring a potential difference of the source by subtracting the source potential value of the other pixel from the source potential value of the reference pixel, that is the threshold change.

12. The method of compensating AMOLED pixel difference according to claim 11, wherein the step of acquiring a coefficient ratio of the coefficient of the driving thin film transistor corresponding to the other pixel relative to the coefficient of the driving thin film transistor corresponding to the reference pixel comprises the following specific steps:

respectively inputting potentials the gate and the source of each pixel driving thin film transistor, wherein the potential value of each pixel gate inputted is the sum of the data voltage value and the threshold change, and each pixel source potential value is the same;

disconnecting the input potentials of the gate and the source, and after the same time, acquiring a source potential value of each pixel, and calculating the coefficient ratio by the formula Kref/K=(Vsampref−Vcm)/(Vsamp−Vcm), wherein Kref/K represents the coefficient ratio, Vcm represents the input source potential value, Vsampref and Vsamp respectively represent the source potential values of the reference pixel and the other pixel acquired after disconnecting the input potential and after the same time.

13. The method of compensating AMOLED pixel difference according to claim 12, wherein the compensating the other pixel difference according to the threshold change, the coefficient ratio and the power value in the driving current calculation formula comprises the following specific steps:

compensating the difference of the driving thin film transistor coefficient corresponding to the other pixel, wherein the compensation formula is:

$$Vgs' = \sqrt[x]{Kref / K} * Vgs,$$

x is the power value in the driving current calculation formula, Vgs is the driving voltage value before the compensation;

compensating the difference of the driving thin film transistor threshold voltage corresponding to the other pixel, wherein the compensation formula is: Vgs"=Vgs'+Vthref+ΔVth, ΔVth is the threshold change, Vthref is the threshold voltage of the reference pixel, and Vgs' is the driving voltage value after the coefficient difference compensation.

14. The method of compensating AMOLED pixel difference according to claim 8, wherein the common voltage terminal is grounded.

* * * * *